US008093573B2

(12) United States Patent
Dougherty

(10) Patent No.: US 8,093,573 B2
(45) Date of Patent: Jan. 10, 2012

(54) CONTAINER FOR TRANSPORTING AND STORING URANIUM HEXAFLOURIDE

(75) Inventor: Thomas F. Dougherty, Chagrin Falls, OH (US)

(73) Assignee: Columbiana Hi Tech LLC, Greensboro, NC (US)

( * ) Notice: Subject to any disclaimer, the term of this patent is extended or adjusted under 35 U.S.C. 154(b) by 301 days.

(21) Appl. No.: 12/567,396

(22) Filed: Sep. 25, 2009

(65) Prior Publication Data

US 2010/0155626 A1 Jun. 24, 2010

Related U.S. Application Data

(60) Provisional application No. 61/100,109, filed on Sep. 25, 2008.

(51) Int. Cl.
*G21F 5/12* (2006.01)

(52) U.S. Cl. ..... 250/507.1; 250/506.1

(58) Field of Classification Search ..... 250/507.1, 250/506.1

See application file for complete search history.

(56) References Cited

U.S. PATENT DOCUMENTS

| | | | | | |
|---|---|---|---|---|---|
| 3,845,315 | A | * | 10/1974 | Blum | 250/506.1 |
| 4,175,669 | A | | 11/1979 | Greer et al. | |
| 4,698,510 | A | * | 10/1987 | Handke et al. | 250/506.1 |
| 4,810,890 | A | | 3/1989 | Blum | |
| 5,061,858 | A | | 10/1991 | Mallory | |
| 5,513,232 | A | | 4/1996 | Jones | |
| 5,777,343 | A | | 7/1998 | Rasel et al. | |
| 6,534,776 | B2 | | 3/2003 | Dougherty et al. | |
| 6,671,344 | B2 | | 12/2003 | Matsunaga et al. | |
| 6,765,221 | B2 | | 7/2004 | Elder et al. | |
| 6,805,253 | B1 | | 10/2004 | Nicholson et al. | |
| 6,990,166 | B2 | | 1/2006 | Matsunaga et al. | |
| 7,971,497 | B2 | * | 7/2011 | Gershtein et al. | 73/865.8 |
| 2007/0081621 | A1 | | 4/2007 | Georgii | |

FOREIGN PATENT DOCUMENTS

| | | | |
|---|---|---|---|
| EP | 0226485 | A1 | 6/1987 |
| KR | 1020060110350 | A | 10/2006 |
| WO | 9954887 | A1 | 10/1999 |
| WO | 0122430 | A1 | 3/2001 |

* cited by examiner

*Primary Examiner* — Kiet Nguyen
(74) *Attorney, Agent, or Firm* — Hahn, Loeser & Parks LLP

(57) ABSTRACT

A vessel for storing and transporting hazardous substances, like for example Uranium Hexafluoride, includes a body having an internal region that is subdivided into two or more isolated regions. The vessel further includes end members that house ingress and egress valves. A cover assembly is affixed to the vessel to shield the valves from damage due to exposure and/or impact.

15 Claims, 5 Drawing Sheets

CONTAINER FOR TRANSPORTING AND STORING URANIUM HEXAFLOURIDE

This utility patent application claims priority to U.S. provisional patent application Ser. 61/100,109 filed on Sep. 25, 2008, entitled Container For Transporting And Storing Uranium Hexafluoride, which is incorporated herein by reference in its entirety.

TECHNICAL FIELD

The present invention pertains to pressurized vessels for transporting and storing Uranium Hexafluoride with enrichments of the isotope U235 greater than 5 weight percent but less than 20 weight percent.

BACKGROUND OF THE INVENTION

It is appreciated that Uranium Hexafluoride (UF6) is useful for its intended purpose. However, exposure of this substance to the general public can be quite hazardous, and accordingly there is a need to ensure containment, especially during transportation. Currently, Uranium Hexafluoride is stored and transported in conventional cylinders, like conventional cylinders ANSI N14.1 30B or 30C cylinder. Regulations require that cylinders be stored in approved protective shipping packages (PSP) during transportation, which limits exposure of the container to hypothetical accident conditions. Hypothetical accident conditions refer to potential situation where the PSP could be dropped, subjected to a fire event, immersed in water, or otherwise damaged. The primary concerns are critical events or release of radioactive materials.

Natural UF6 contains the isotope $U_{235}$ in a weight percent of 7/10 of one percent. The isotope $U_{235}$ emits neutrons and, in the enriched state, gives UF6 is radioactive characteristics. Enriched UF6 has a weight percentage of the $U_{235}$ greater than 7/10 of one percent. The industry standard for the commercial use of enriched UF6 includes weight percentages extending up to five percent. In the enriched state, UF6 can become critical given the right circumstances, for which the chance of becoming critical increases with the amount of $U_{235}$ present. Moderators slow the movement of emitted neutrons thereby increasing the possibility of a collision, which can trigger a critical event. Persons skilled in the art refer to the $K_{eff}$ factor, where a $K_{eff}$ greater than 1.0 relates to a condition where the number of neutrons are increasing resulting in a critical event. Conversely for a $K_{eff}$ less than 1.0, neutrons are being absorbed. Water is one such moderator of UF6. Accordingly, it is important to ensure that UF6 does not become exposed to water or water based substances. If the storage container valves and plugs become damaged and/or deteriorate, the possibility of contact with water significantly increases, as does the possibility of a critical event.

One factor contributing to a critical event pertains to the amount of $U_{235}$ present within a cylinder. Of course, the amount of any substance that can be stored in a given container is limited by the container's construction, namely the dimensions of the cylinder walls. For precautionary reasons, regulations limit the weight quantity of $U_{235}$ that can be stored in a container to five (5) weight percent of the total volume of material stored in a cylinder. However, in recent years the industry has been desirous of shipping and storing enriched UF6 containing $U_{235}$ in weight percentages in excess of five (5) percent.

Currently, the state of the art does not provide a cylinder that is safe by geometry incorporating an annulus base and having a $K_{eff}$ less than 1.0. A need therefore exists to provide containers for transporting enriched UF6 having $U_{235}$ between five weight percent and twenty weight percent. Advantages of the embodiments of the subject invention will become apparent to those skilled in the art.

BRIEF SUMMARY

The embodiments of the present invention pertain to a container for transporting enriched UF6 having a weight percentage of $U_{235}$ greater than five percent and less than twenty percent where the $K_{eff}$ is less than 1.0.

The embodiments of the present invention pertain to a container for transporting enriched UF6 that is safe by geometry. The container functions to prevent a critical event by controlling the internal volume of the container.

In one aspect of the embodiments of the subject invention, the geometry of the container is controlled by incorporating an annulus base into the container.

In another aspect of the embodiments of the subject invention, the volume contained within the annulus base is devoid of material.

In still another aspect of the embodiments of the subject invention, the annulus base may comprise an assembly of wall members that change the effective storage volume of the container.

In yet another aspect of the embodiments of the subject invention, the annulus base is constructed by segregating internal space within the container into two isolated volumes; one used for storage of substances like UF6 and the other volume sealed from receiving substances.

In another embodiment of the present invention, a container for storing substances, which may be hazardous substances like for example Uranium Hexafluoride, includes a body and one or more end members that define an internal region having a volume V for storing the associated hazardous substances and one or more valves that control the ingress and egress of the hazardous substance to and from the container. Additionally, plugs may be installed into other apertures fashioned in the container. Means for protecting the valves and plugs may be incorporated to prevent damage and deterioration thus providing an extra measure of safety.

In one aspect of the embodiments of the subject invention, said means is comprised of a valve cap and a valve base.

The embodiments of the present invention pertain to a container for storing substances, which may be hazardous substances like for example Uranium Hexafluoride. The vessel may include a base having a body and one or more end members that define an internal region having a volume V for storing the associated hazardous substances, and a compartment fashioned within the internal region of the vessel defining a smaller volume V1 wherein the compartment is sealed with respect to the internal region, and at least one valve for filling the vessel with the associated hazardous substances.

DETAILED DESCRIPTION OF THE INVENTION

Figure 1:
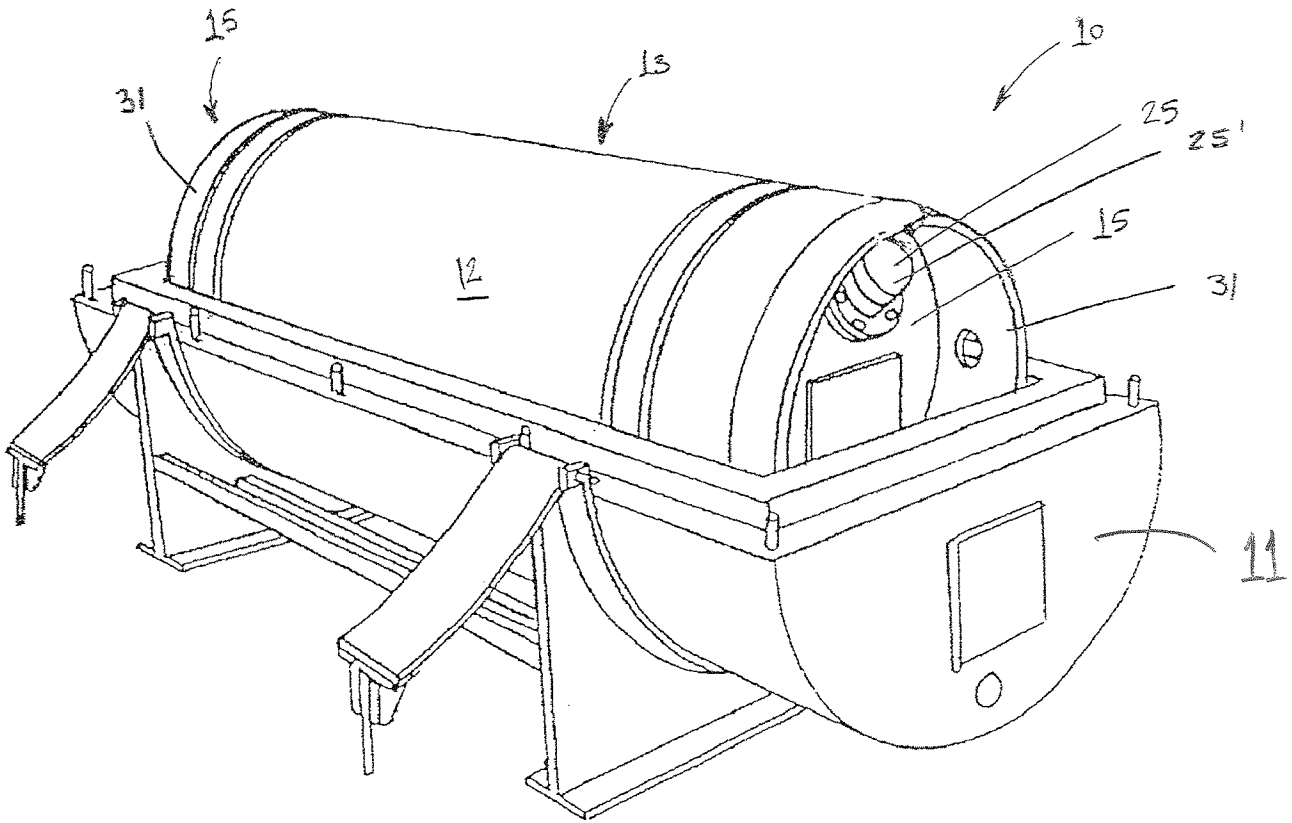
FIG. 1 is a perspective view of a container for storing hazardous substances according to the embodiments of the invention.

Referring now to the drawings wherein the showings are for purposes of illustrating embodiments of the invention only and not for purposes of limiting the same, FIG. 1 shows a transportation and/or storage vessel depicted generally at 10. The vessel 10 may be constructed to contain substances deemed hazardous for exposure to humans. In one embodiment, the vessel 10 may store radioactive materials, one example of which includes Uranium Hexafluoride (also termed $UF_6$). It will be appreciated that regulations may exist which provide certain design or usage constraints for a vessel of this type. However, it is to be construed that vessel 10 of the embodiments of the subject invention may be used with any type of hazardous material, radioactive or otherwise.

The vessel 10 may be fashioned as a generally cylindrical container and may include a main body 12 along with distally arranged end members 15. The body 12 and end members 15 define an interior region for storing the hazardous materials. The body 12 of the storage vessel 10 is symmetrically fashioned around a central, longitudinal axis Y, see FIG. 2, and may correspondingly have a circular cross section, which is particularly suitable for storing pressurized substances. Accordingly, the end members 15 may be affixed to the body 12 in a manner suitable for preventing the leakage of the vessel's 10 contents, even under severe conditions. In one embodiment, the end members 15 may be welded to the body 12 as will be discussed further in a subsequent paragraph.

Figure 1A:
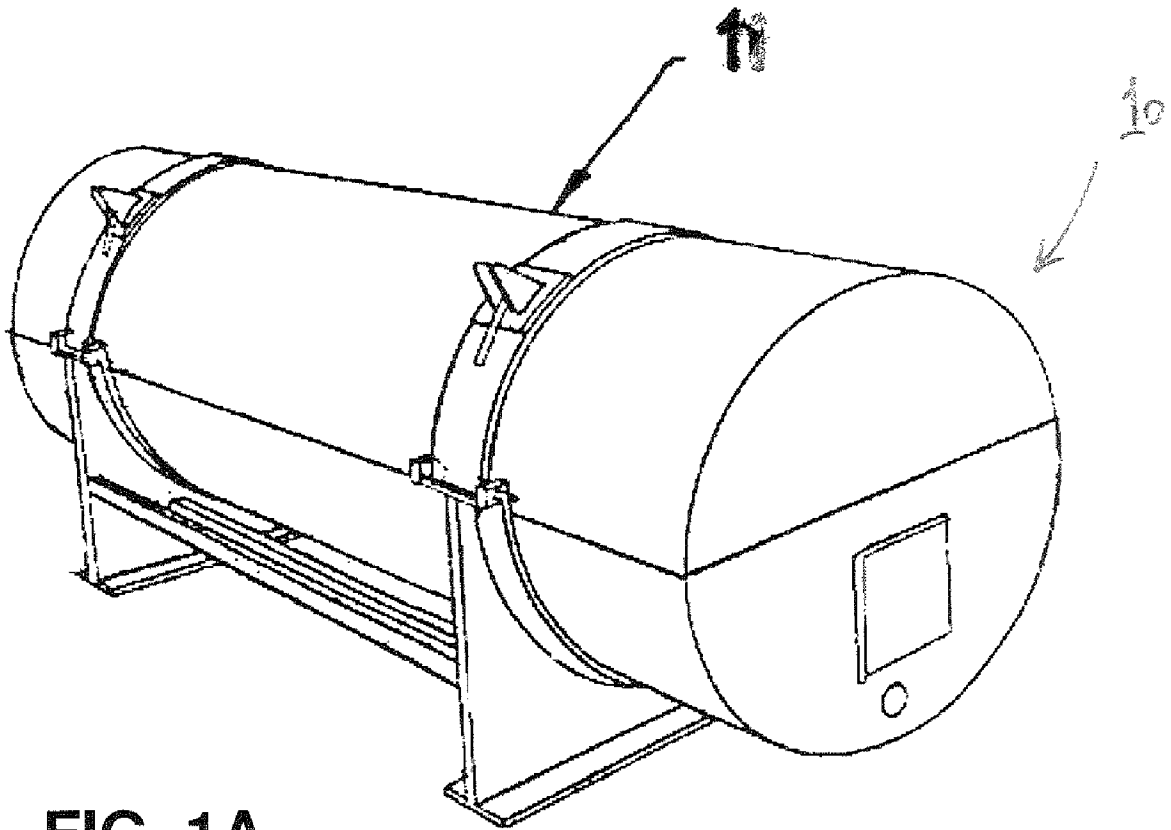
FIG. 1*a* is a perspective view of a container for storing hazardous substances received within a protective shipping package according to the embodiments of the invention.

Referring to FIGS. 1 and 1*a*, in one embodiment the vessel 10 may be received by a protective shipping package 11 also referred to as an overpack 11, which may be a standard size overpack for 30B containers as regulated by governmental agencies. The protective shipping package 11 may function to protect the vessel 10 from impact or other damage as well as ambient conditions. The protective shipping package 11, and corresponding vessel 10 filled with hazardous material, may be placed into a cradle for storage or handling during transportation.

Figure 3:
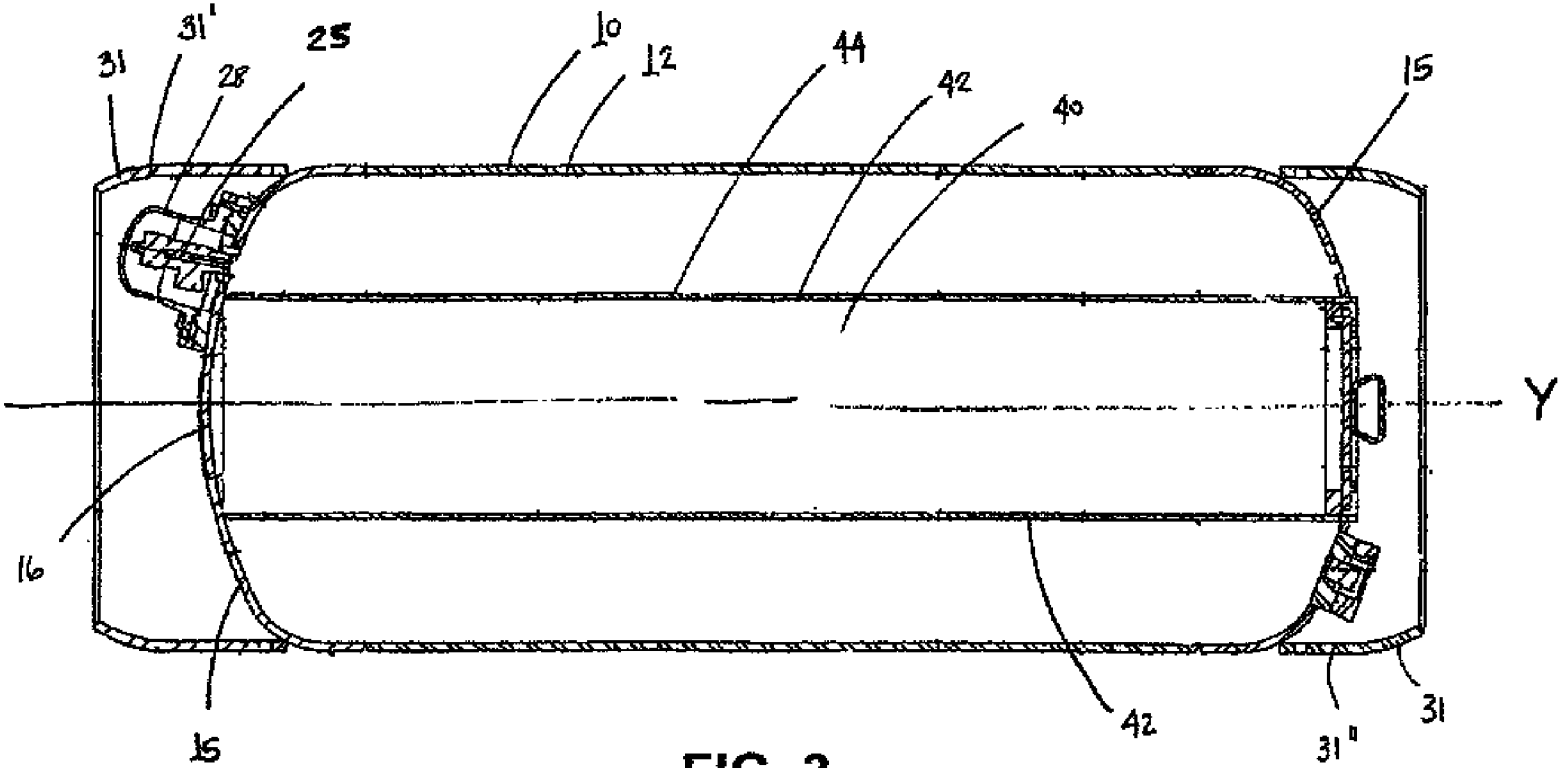
FIG. 3 is a partial cutaway side view showing compartments of the container shown in FIG. 1 according to the embodiments of the invention.

For filling and emptying the vessel 10, means are included that allow for the ingress and egress of a particular substance. In particular, valves 25 may be installed into the walls of the vessel 10 for transferring Uranium Hexafluoride into and out of the vessel 10 as needed. An inlet valve 25' may be provided at a first end. Additionally, an outlet valve 25" may be incorporated into the distal end of the vessel 10. It is well known in the art that substances like Uranium Hexafluoride react violently with water or water based substances. Accordingly, the valves 25 may be specifically constructed and installed to withstand damage during use and/or deterioration from exposure to ambient conditions that would allow substances of this nature to intermix. As an additional measure of safety, a valve cap or cover 28, shown in FIGS. 3 and 4, and system for sealing the valve cover 28 may be incorporated as will be discussed in detail below.

Referring again to FIG. 1, the body 12 may be constructed from sheet steel roll-formed into the straight cylindrical configuration. In one embodiment, the sheet steel may have a minimum thickness of 13/32 inch and have a length of substantially 81½ inches long. When roll-formed, the I.D., i.e. inner diameter, may be 29¼ inches. Additionally, the type of steel utilized in constructing the body 12 may be ASME SA-516 Grade 70 carbon steel. However, other grades of steel may be used that conform to the proper regulatory restrictions including but not limited to Title 49 of the Code of Federal Regulations. Once the steel body 12 has been formed into a cylinder, the seam 13 may be fused together by welding to join the sides of the body 12. In one embodiment, the seam 13 may be fusion welded. In another embodiment, the seam 13 may forge welded. However, any means of constructing the container 10 may be chosen as is appropriate for use with the embodiments of the present invention.

The end members 15 may be constructed from the same type of material as that of the body 12, namely SA-516 Grade 70 carbon steel. However, the thickness of the end members 15 may be thicker than the body 12. In one embodiment, the thickness is approximately 0.7 inch. A minimum thickness may be 11/16 inch. However, any thickness above the minimum thickness may be chosen with sound judgment as is appropriate for use with the embodiments of the subject invention. The end members 15 may be fashioned in the shape of a disk or plate having an outer diameter corresponding to the inner diameter of the body 12. The end members 15 may be curved at their respective center portions 16 thereby defining a domed shape with a corresponding radius that extends to a circumferential edge. In one embodiment, the corresponding radius is uniform from a center point to the circumferential edge. When juxtaposed to the body 12, the curved portion of the end members 15 may be concave with respect to the interior region of the container 10. It is noted here that the container 10 may include two end members 15, each one disposed on distal ends of the body 12.

The ends of the vessel 10 may respectively include chimes 31. Each of the chimes 31 may extend from the body 12 and/or end members 15 of the vessel 10. The chimes 31 function to protect the end of the vessel 10 and more particularly the valves or other components mounted to the end members 15. In this manner, should the vessel 10 impact the ground or other structure, force from the impact may be translated to the chimes 31 protecting the valves from damage. Of course, it will be readily seen that the first and second chimes 31', 31" are respectively mounted at distal ends of the vessel 10 for protecting valves 25', 25" and/or plugs as may be respectively installed into the end members 15. It is expressly noted here that the length of the first and second chimes 31', 31" may not be equal. That is to say that one chime 31' may be substantially longer than the other chime 31". Any difference in length may be selected that appropriately protects the various components, e.g. valves, plugs and the like, installed into the end members 15. In an exemplary manner, one chime 31' may have a length of substantially 9 inches. The other chime 31" may have a length of substantially 12 inches. It is noted that the respective length of the chimes 31', 31" may vary widely. However, regulatory constraints may be in place that restrict the overall length of the container. Accordingly, any proportional length of the chimes 31', 31" may be chosen that falls within the required guidelines governing the use and construction of the vessel 10.

Figure 2:
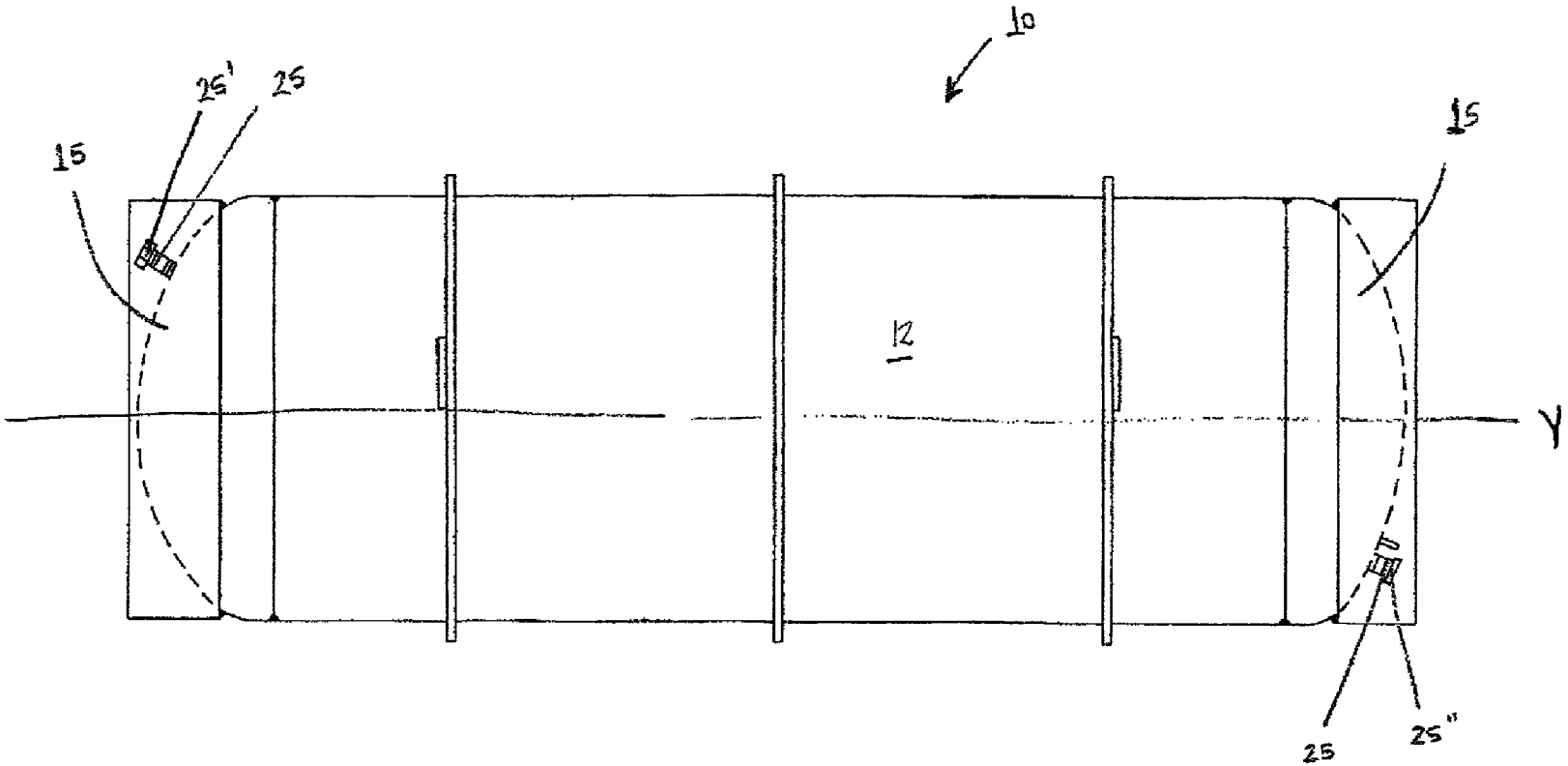
FIG. 2 is a side view of the container for storing hazardous substances shown in FIG. 1 according to the embodiments of the invention.

With reference to FIG. 2, the vessel 10 may incorporate a region, referred to herein as a compartment 40, sub-dividing the interior of the vessel 10 for limiting the amount of the material stored in the vessel 10. The compartment 40 is fashioned internally with respect to the vessel walls and the corresponding end members 15. The compartment 40 may include compartment walls 42 configured so as to separate the interior of the vessel 10 into two isolated regions. One region may remain substantially empty. The other region may be at least partially filled with hazardous materials as mentioned above. It is noted that the compartments are completely isolated. In other words, materials stored in one region, or compartment, cannot fluidly flow in the other region. In one embodiment, the compartment walls 42 are disposed entirely within the vessel 10. Accordingly, one interior region of the vessel 10, i.e. compartment region 40, may be defined entirely by the geometry of the compartment walls 42. The volume of the second interior region can be calculated by the difference between the overall volume of the vessel 10 and that of the compartment 40 volume. It will be appreciated by persons of ordinary skill in the art that any cross section of the compartment 40 may be chosen without departing from the intended scope of coverage of the embodiments of the subject invention.

In forming the compartment 40, one or more rigid wall members 42 may be positioned within the body 12 of the vessel 10 and affixed thereto in any manner chosen with sound engineering judgment. In one exemplary manner, a contiguously formed tubular member 44 is used comprised of steel pipe. The pipe may be inserted into the vessel 10 and welded to the respective end members 15, thereby fashioning a generally longitudinal compartment that limits the amount of material stored in the vessel. However, other ways of constructing the compartment 40 may incorporate welding steel sheets together in a generally polygonal fashion. Any cross sectional configuration of the compartment 40 may be chosen as is appropriate for use with the embodiments of the present invention. It is noted here that the type of material used to construct the compartment walls 42 is not limited to steel. Rather steel alloys or other metal alloys may be selected as is appropriate for use with the embodiments of the present invention.

As mentioned above, the vessel 10 may further include a valve 25 used to fill the vessel 10 with the hazardous substance. The valve 25 opens to allow substances like Uranium Hexafluoride to enter the vessel 10 and closes to securely and safely seal the contents inside. To ensure safety, the valve 25 may be protected by a valve cover 28, shown in FIG. 4. The valve cover 28 provides an additional barrier to the egress of Uranium Hexafluoride and more critically to the ingress of water into the vessel 10 through the valve 25. The valve cover 28 may be disposed within the chime 31 area, which extends from the domed end of the vessel 10, as mentioned above. More particularly, the distal end of the valve cover 28 may be recessed by at least 0.5 inch and preferably 0.75 inch or more from a plane defined by the free edge of the chime 31. This space allows for deformation of an over-pack during drop testing, or other impact, without any contact with the valve cover 28. Therefore the vessel 10 fitted with the valve cover 28 may be used with standard over-packs as may be required by rules governing the storage and transportation of the hazardous materials.

Figure 4:
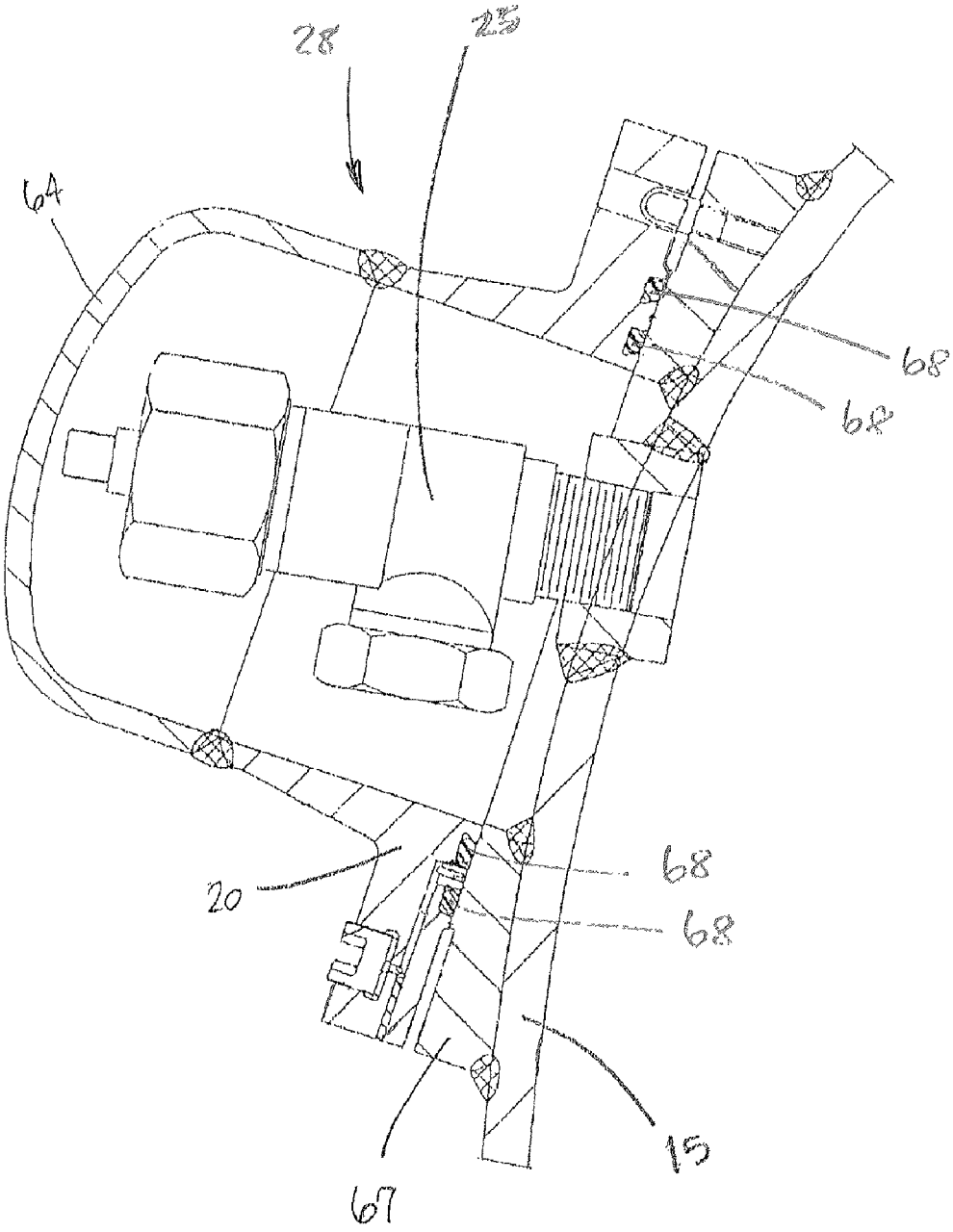
FIG. 4 is an enlarged, partial cutaway side view of the valve shown in FIG. 3, according to the embodiments of the invention.

With reference to FIG. 4, the valve cover 28 may be comprised of a valve cover cap 64 and a valve cover base 20. The valve cover base 20 may have an annular shape for surrounding the valve 25 installed into the end member 15. Its diameter and thickness may be chosen so as not to interfere with the standard industry plumbing used to connect with the valve 25 to fill or empty the vessel 10 of its contents. The valve cover 28 is held in place by one or more bolts, not shown. In an exemplary manner, six (6) bolts in all may be used. Two of the bolts may be safety wired for guaranteeing that the valve cover 28 has not been tampered with once installed.

The valve cover 28 also includes a valve cover flange 67, which may comprise a disk welded to the end member 15 of the vessel 10. The welds provide a barrier to prevent matter, like water for example, from passing under the valve cover flange 67 and into the valve cover 28. In an exemplary manner, the valve cover flange 67 may include six (6) equidistantly spaced and threaded holes fashioned to receive fasteners for holding the valve cover 28 in place.

In one embodiment, an upper surface of the valve cover flange 67 includes an inner region and an outer region. The inner region is annularly shaped and adjacent to the outer region having a height differential of approximately 1/32 inch. The inner region may be machined substantially flat, which provides a surface against which the valve cover base 20 seals.

The valve cover 28 may be constructed from one or more steel components, which in one embodiment, includes the valve cover cap 64 and the valve cover base 20. The base 20 mates with the valve cover flange 67 and includes a machined surface that seats against the corresponding surface of the valve cover flange 67. O-rings 68 fit into corresponding recesses, respectively fashioned into the base 20. Any shape of recesses and corresponding O-rings 68 may be chosen without departing from the intended scope of coverage of the embodiments of the subject invention. When the annular surface of the flange and the annular surface of the valve cover base are seated against each other, the O-rings 68 are compressed to form an effective and essentially impermeable seal.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A vessel for transporting and/or storing of enriched uranium hexafluoride with $U_{235}$ isotope levels greater than five weight percent but less than 20 weight percent, comprising:

a base having a body and one or more end members that define an internal region having a volume V storing enriched uranium hexafluoride, wherein the vessel is subdivided into isolated compartments wherein the weight percentage of the enriched uranium hexafluoride stored in the vessel is controlled by geometry of subdivided compartments.

2. The vessel as defined in claim 1, further comprising:

a valve suitable to fluidly communicate enriched uranium hexafluoride, the valve being operatively connected to the one or more end members and in fluid communication with only one of the subdivided compartments; and, means for protecting the valve.

3. The vessel as defined in claim 2, further comprises:

protective shipping package at least partially encapsulating the vessel.

4. A vessel for transporting enriched uranium hexafluoride, comprising:

a cylindrical body defining a longitudinal axis and having first and second ends defining an internal region;

first and second domed end members each defining a center and a circumferential edge, wherein the first and second domed end members are uniformly arched from the center to the circumferential edge, the first and second end members being fusion welded to the first and second ends of the cylindrical body respectively, wherein the first and second end members are concave with respect to the internal region;

wherein the cylindrical body and the first and second ends define a shell having an internal volume V, wherein the shell is subdivided into a first compartment containing enriched uranium hexafluoride and a second isolated compartment devoid of enriched uranium hexafluoride, wherein the first and second compartments are fluidly isolated with respect to each other, wherein the second isolated compartment is generally longitudinal extending from the first domed end member to the second domed end member and center about the longitudinal axis of the cylindrical body;

a valve suitable to fluidly communicate radioactive material, the valve being operatively connected to the first domed end member and in fluid communication exclusively with the first compartment;

a valve cover operatively attached to the vessel, wherein the valve cover includes valve cover cap and a valve cover base incorporating one or more o-rings for inhibiting fluid from passing into the valve cover;

first and second chimes fixedly attached to and extending axially from distal ends of the vessel; and, a protective shipping package.

5. A vessel for storing and transporting radioactive material, comprising:

a tubular body defining tubular body ends;

first and second domed end members fixedly attached to respective ends of the tubular body thereby forming a shell that defines an interior region for storing radioactive material, wherein the interior region of the shell is subdivided into first and second compartments fluidly isolated by one or more wall members, wherein the first compartment defines a first volume storing radioactive material, wherein the second compartment has a geometry that defines a second volume limiting the weight percentage of radioactive material stored in the vessel; and, a valve suitable to fluidly communicate radioactive material, the valve being operatively connected to the first domed end member and in fluid communication exclusively with the first compartment.

6. The vessel as defined in claim 5, further comprising:

a protective shipping package encapsulating the vessel.

7. The vessel as defined in claim 6, further comprising:

an annular chime fixedly attached to the vessel and extending axially from the first domed end member for protecting the valve from damage.

8. The vessel as defined in claim 7, further comprising:

a valve cover completely encapsulating the valve for protecting the valve.

9. The vessel as defined in claim 8, wherein the valve cover comprises:

a valve cover cap; and, a valve cover base incorporating one or more o-rings for inhibiting fluid from passing into the valve cover.

10. The vessel as defined in claim 8, wherein the valve cover is recessed with respect to an end of the annular chime.

11. The vessel as defined in claim 7, wherein the vessel includes first and second chimes extending from distal ends of the vessel, wherein the first chime is substantially longer than the second chime.

12. The vessel as defined in claim 5, wherein the tubular body and the first and second domed end members are constructed from ASME SA-516 grade 70 carbon steel.

13. The vessel as defined in claim 12, wherein the first and second domed end members are curved from a center point to a circumferential edge; and, wherein the first and second domed end members are concavely oriented with respect the interior region.

14. The vessel as defined in claim 5, wherein the tubular body defines a longitudinal axis, and wherein the second compartment extends longitudinally from the first domed end member to the second domed end member about the longitudinal axis.

15. The vessel as defined in claim 5, wherein the second compartment defines a volume that limits the amount of radioactive material stored in the vessel such that the $K_{eff}$ of the vessel is less than 1.

* * * * *